US006256917B1

(12) United States Patent
Findlay

(10) Patent No.: US 6,256,917 B1
(45) Date of Patent: Jul. 10, 2001

(54) LOCKABLE SAFETY FOR FIREARMS

(75) Inventor: David S. Findlay, Mohawk, NY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 09/353,981

(22) Filed: Jul. 15, 1999

(51) Int. Cl.[7] ..... F41A 17/00
(52) U.S. Cl. ..... 42/70.06; 42/70.11
(58) Field of Search ..... 42/70.06, 70.01

(56) References Cited

U.S. PATENT DOCUMENTS

| | | | | |
|---|---|---|---|---|
| 2,000,858 | * | 5/1935 | Maxwell | 42/70 |
| 2,225,583 | * | 12/1940 | Blizard | 42/70.11 |
| 2,599,132 | * | 6/1952 | Sass | 42/70 |
| 2,664,658 | * | 1/1954 | Bjorklund | 42/70 |
| 2,675,638 | * | 4/1954 | Crittendon | 42/69 |
| 2,856,718 | | 10/1958 | Fischer | 42/70 |
| 3,462,869 | * | 8/1969 | Wallace | 42/70 |
| 3,553,877 | * | 1/1971 | Welch et al. | 42/70 |
| 3,673,725 | | 7/1972 | Cravener | 42/70 |
| 3,882,622 | * | 5/1975 | Perlotto | 42/1 |
| 4,133,128 | * | 1/1979 | Brush | 42/70 |
| 4,719,713 | * | 1/1988 | Hagle | 42/1.01 |
| 4,726,136 | | 2/1988 | Dornaus et al. | 42/70.08 |
| 4,754,568 | * | 7/1988 | Brandt | 42/70.06 |
| 5,068,990 | | 12/1991 | Marzocco | 42/70.04 |
| 5,417,001 | * | 5/1995 | Rousseau | 42/70.08 |
| 5,467,550 | | 11/1995 | Mumbleau | 42/70.11 |
| 5,671,560 | | 9/1997 | Meller | 42/70.11 |
| 5,867,928 | * | 2/1999 | Plebani | 42/17 |
| 5,910,003 | | 6/1999 | Kleinpaul | 42/70.11 |
| 6,141,896 | * | 11/2000 | Oberst | 42/70.06 |

FOREIGN PATENT DOCUMENTS 4303333 6/1994 (DE) .

* cited by examiner

*Primary Examiner*—Charles T. Jordan
*Assistant Examiner*—Denise J Buckley
(74) *Attorney, Agent, or Firm*—Huntley & Associates

(57) ABSTRACT

A lockable safety mechanism for use in a wide variety of firearms and moveable among a safe position, a fire position, and a safe and locked position.

11 Claims, 3 Drawing Sheets

LOCKABLE SAFETY FOR FIREARMS

BACKGROUND OF THE INVENTION

This invention relates generally to safety mechanisms for use in firearms and more particularly to a lockable safety mechanism able to prevent firing when in the safety mode and to prevent unauthorized use of the firearm when in the locked mode. There is a continued need for a device that is easy to use yet effectively deters unauthorized use of the firearm, and a particular need for a device that operates in a manner that is similar to previous safety mechanisms, yet also provides a locking function.

SUMMARY OF THE INVENTION

The present invention provides safety mechanisms that also provide a locking function, thus satisfying the need for a means of deterring unauthorized use of the firearm.

Specifically, one embodiment of the present invention provides a safety mechanism for use in a firearm comprising:

A. a safety button having a first end and a second end and comprising:
   i. a locking aperture formed along a substantially longitudinal axis of the button comprising a female receiving end formed in the first end of the button;
   ii. a receiving notch formed in the surface of the button between the first and second ends of the button;
   iii. a plunger aperture formed in the surface of the button between the first and second ends of the button, extending substantially transverse to the longitudinal axis of the button toward the central axis of the button and connecting with the substantially longitudinal locking aperture, the plunger aperture being operatively connected to:
   iv. a substantially transverse plunger channel, operatively connected to:
   v. a first portion of a substantially longitudinal plunger channel, the substantially longitudinal plunger channel comprising the first portion and an operatively connected second portion, each portion being separated by a detent surface;

B. a detent plunger;

C. means to bias the detent plunger towards the safety button and into a position where the detent plunger interacts with one of the plunger aperture, the substantially longitudinal plunger channel and the substantially transverse plunger channel; and D. locking means adapted for insertion into the female receiving end of the locking aperture of the safety button, wherein the locking means is adapted to interact with the plunger aperture when inserted into the female receiving end.

In another embodiment of the present invention there is provided a safety mechanism for use in a firearm comprising:

A. a safety button having a first end and a second end and comprising:
   i. a locking aperture formed along a substantially longitudinal axis of the button comprising a female receiving end formed in the first end of the button;
   ii. a receiving notch formed in the surface of the button between the first and second ends of the button;
   iii. a plunger aperture formed in the surface of the button between the first and second ends of the button, extending substantially transverse to the longitudinal axis of the button toward the central axis of the button and connecting with the substantially longitudinal locking aperture, the plunger aperture being operatively connected to:
   iv. a plunger channel; and B. a detent plunger;

C. a spring positioned to bias the detent plunger towards the safety button and into a position where the detent plunger interacts with one of the plunger aperture, substantially longitudinal plunger channel and substantially transverse plunger channel; and D. a key adapted for insertion into the female receiving end of the locking aperture of the safety button, wherein the key is adapted to interact with the plunger aperture when inserted into the female receiving end.

In a further embodiment of the present invention there is provided a safety mechanism for use in a firearm comprising:

a safety button transversely movable between a safe and a fire position and rotatable between the safe position and a safe and locked position;

a detent plunger adapted to lock the safety button in the safe and locked position and to prevent further movement of the safety button; and a key adapted to be received through a key hole formed in the safety button, the key being adapted to engage the detent plunger for moving said detent plunger out of engagement with said safety button to enable rotation of the safety button from the safe and locked position to the safe position.

Yet another embodiment of the invention provides a safety mechanism for a firearm comprising:

a safety button transversely movable between a safe to restrict operation of the firearm and a fire position and rotatable between the safe position and the safe and locked position, and including first and second ends and a locking aperture formed through the safety button, and a detent plunger adapted to engage the safety button as the safety button is moved to its safe and locked position to restrict further rotation of the safety button and maintain the safety button in its safe and locked position to prevent rotation of the safety button from the safe and locked position to the safe position.

DETAILED DESCRIPTION OF THE INVENTION

Figure 1:
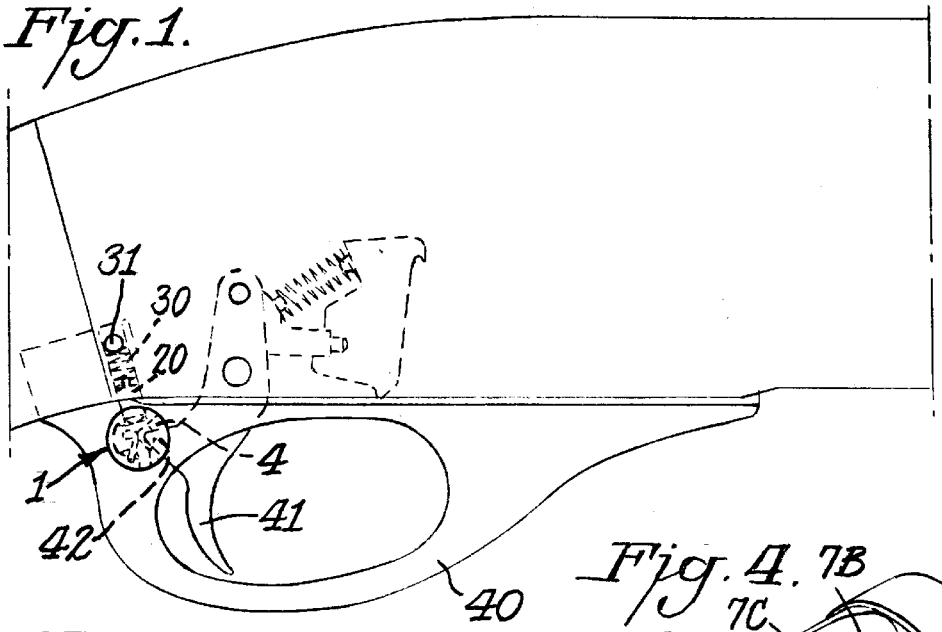
FIG. 1 is a fragmented side elevational view of a firearm having a safety mechanism of the present invention, with the safety mechanism in the fire 10 position.

The present invention will be more fully understood by reference to the drawings, which show one preferred embodiment of a lockable safety mechanism of the present invention. Variations and modifications of this embodiment can be substituted without departing from the principles of the invention, as will be evident to those skilled in the art.

The preferred embodiment of the safety mechanism shown in the Figures are pictured in a firearm having a trigger mechanism or fire control of the general type disclosed in U.S. Pat. No. 2,675,638 to Crittendon. The Crittendon fire control can be used in a wide variety of firearms, including various shotguns and rifles commercially available from the Remington Arms Company, Inc. As will be evident to those skilled in the art, the present invention can be used in firearms having other types of trigger mechanisms, and can be used in many types of firearms, including handguns, shotguns or rifles. In the following description of possible embodiments of the invention, trigger mechanism refers to a trigger, trigger assembly, fire control or any other device or combination of devices that are designed to be activated by an operator to mechanically fire the firearm.

In addition to being adaptable for use in a wide variety of firearms, the various embodiments of the lockable safety mechanism of the present invention can be located in various positions in the firearm with respect to the trigger mechanism. The particular location of the various safety mechanisms of the present invention will vary depending on the type of firearm, the type of trigger mechanism, and other considerations that will be evident to those skilled in the art. Aesthetics can also be considered in determining where to locate the safety mechanism. As shown in the Figures, the safety mechanism can be placed behind the trigger. Other embodiments of the present invention include locating the safety mechanism in front of and above the trigger, where it can be positioned to block the movement of a component of the trigger mechanism, rather than the trigger itself. In such an alternate position, the safety mechanism can also be positioned to block the movement of a forward end of the trigger itself, rather than blocking the rear end as shown in the Figures.

Accordingly, various embodiments of the lockable safety mechanisms of the present invention can be incorporated into almost any firearm, in almost any location or position within the firearm. Furthermore, the present invention can be positioned to block the movement of any part of a fire control, so long as such blockage would satisfy accepted safety measures and standards.

The wide applicability of the present invention will be more evident to those skilled in the art as a result of the disclosure of the general operating principles of the preferred embodiments of the present invention, as well as the disclosure of the preferred embodiments of the invention shown in FIGS. 1–17. In FIGS. 1–17, the embodiments of the lockable safety mechanism of the present invention are shown in firearms adapted for use by right handed operators, however, the invention is equally applicable to firearms adapted for left handed operators.

The function of the various safety mechanisms of the present invention can be described in general terms that are applicable to a wide variety of embodiments thereof, including those shown in the Figures and discussed in detail below, as will be apparent to those skilled in the art.

The safety mechanisms of the present invention are moveable between two transverse positions, the first being the safe position wherein the safety button prevents movement of the trigger mechanism and thus prevents the trigger from being pulled, and the second being the fire position wherein the safety button is positioned to allow movement of the trigger mechanism. The safety mechanisms of the present invention are also moveable between two rotational positions, the first rotational position being the first transverse or safe position, and the second rotational position being the safe and locked position. Once in the safe and locked rotational position, the safety mechanism cannot be rotated or moved without a key or locking means.

Figure 13:
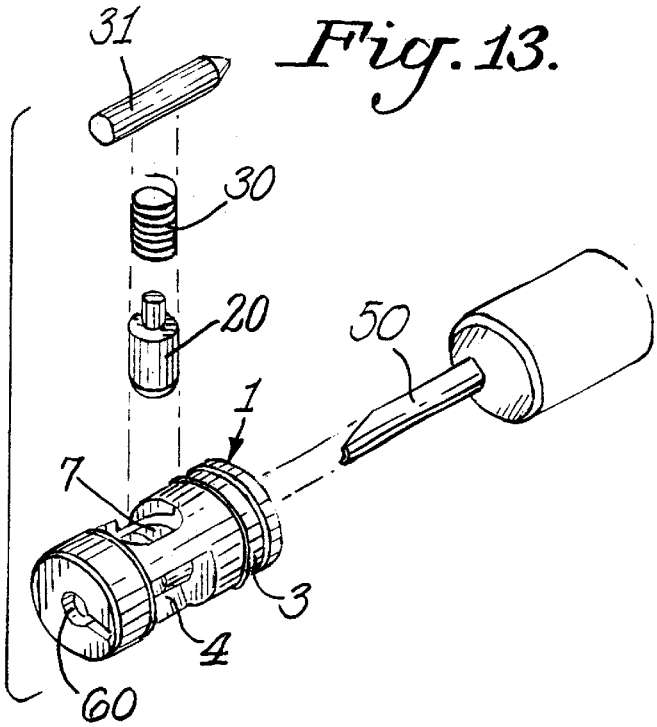
FIG. 13 is an exploded view of a second embodiment of a safety mechanism of the present invention, showing the main elements of the preferred safety mechanisms of the present invention.

As shown in the Figures, the safety mechanisms of the present invention comprise four basic elements. These elements are best shown in FIG. 13, which is an exploded view of the main elements of the preferred safety mechanisms shown herein. The preferred embodiment of a lockable safety mechanism of the present invention comprises a safety button 1, a detent plunger 20, and a plunger spring 30 to bias the detent plunger toward the safety button. Other means to bias or urge the detent plunger toward the safety button can be substituted for the spring. Also shown in FIG. 13 is a pin 31 to secure the plunger spring in place. A key 50 shown in FIG. 13 and in phantom outline in FIG. 2 is the preferred locking means, however, other known locking means can be substituted therefor.

Figure 2:
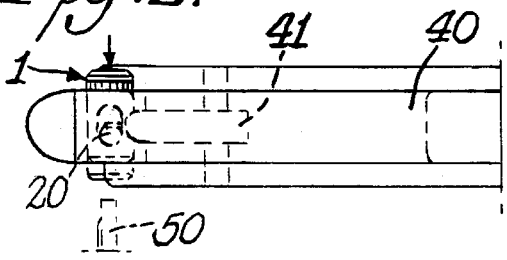
FIG. 2 is a bottom plan view of the firearm of FIG. 1.
Figure 3:
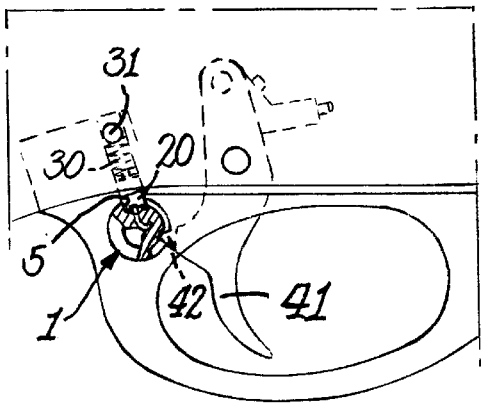
FIG. 3 is a fragmented side elevational view of the safety mechanism of FIG. 1, with the safety mechanism in the safe and locked position.

As shown in FIGS. 1–3, the safety button 1 is positioned within the trigger guard 40 of the firearm, behind the trigger 41, and the detent plunger 20 is mounted within the trigger guard above the safety button, where it is biased downward towards the safety button by the spring 30, which is also mounted within the trigger guard and secured in place by the pin 31.

Figure 12:
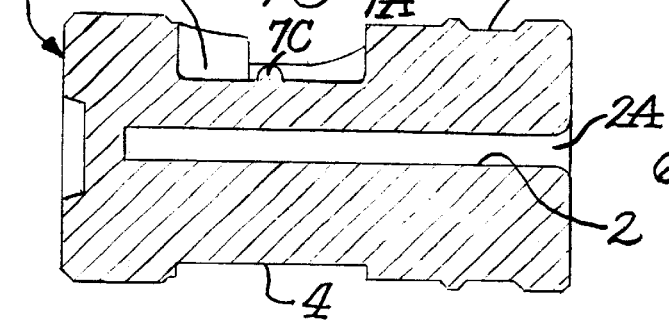
FIG. 12 is a cross sectional view taken along line 12—12 of FIG. 10.

As shown in FIGS. 4–12, the preferred safety button 1 is substantially cylindrical and comprises a locking aperture 2 formed along the longitudinal axis of the button, which is clearly shown in the cross sectional view of the button in FIG. 12. The locking aperture 2 comprises a female receiving end 2A formed in one end of the safety button. The female receiving end of the locking aperture can be formed in either end of the safety button, and the location of the receiving end will be determined by the configuration of the firearm and other considerations such as whether the firearm is adapted for use by a left handed or right handed operator.

Figure 7:
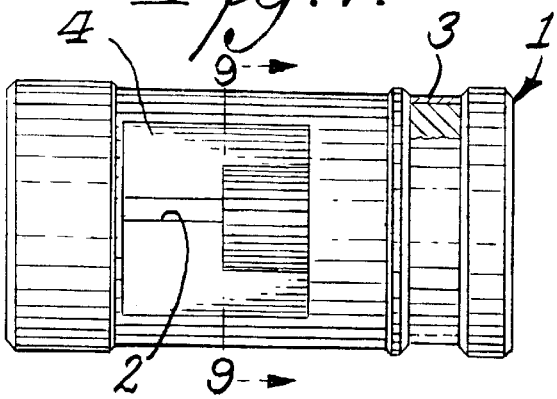
FIG. 7 is a bottom plan view of the safety button of FIG. 4, showing the receiving notch.
Figure 9:
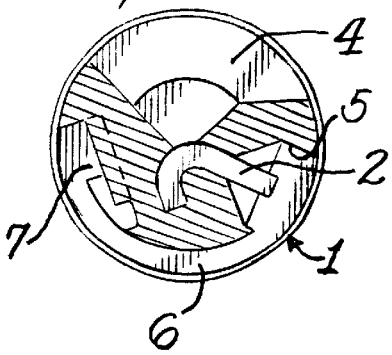
FIG. 9 is a cross sectional view in elevation taken along line 9—9 of FIG. 7.

A receiving notch 4 is formed in the safety button between the two ends of the button, as best shown in FIG. 7. The notch is adapted to receive a portion of the trigger mechanism or part of the fire control, and to thereby allow movement of the trigger mechanism or fire control. The position of this notch will be determined by the position of the safety button in the firearm and the part of the fire control or trigger mechanism that is to be blocked. In the present embodiment of the button, the notch is formed in an offset but substantially central portion of the button, between the two ends of the button, and is positioned to allow the trigger to be pulled when the button is in the fire position, as shown in FIG. 1. When the button is in the second transverse or fire position, the notch is positioned behind the trigger in a position to interact with the tab 42 on the rear of the trigger, allowing the trigger to pivot as it is pulled.

When the safety button is in the first transverse or safe position, the notch is no longer aligned with the trigger, and thus rearward movement of the trigger is blocked by the button, as shown in FIG. 3.

Figure 8:
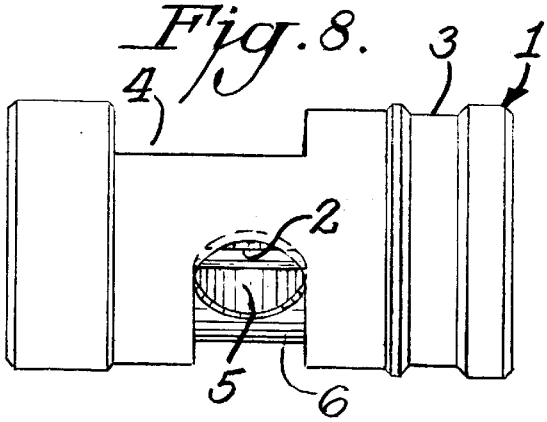
FIG. 8 is a right side elevational view of the safety button of FIGS. 4 through 7.
Figure 10:
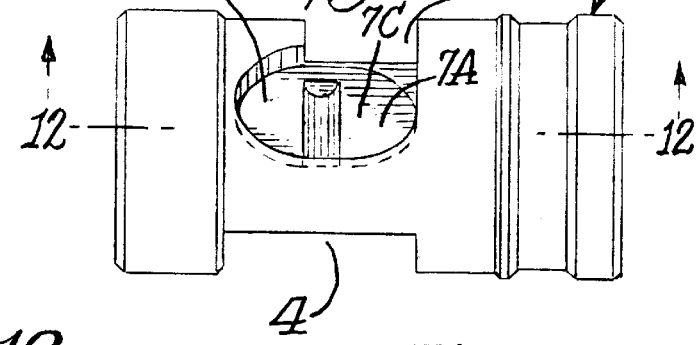
FIG. 10 is a left side elevational view of the safety button of FIGS. 4 through 7.
Figure 17:
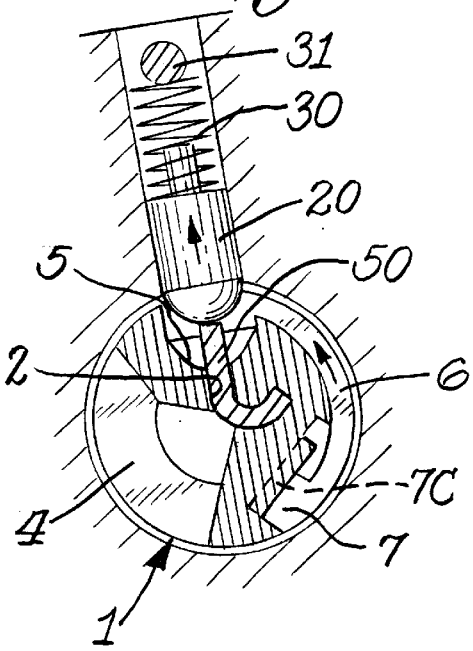
FIG. 17 is a fragmented side elevational view of the safety mechanism of FIGS. 4–7 and FIG. 13, showing the safety button in cross section.

A plunger aperture 5 is formed in the surface of the safety button between the two ends of the button, as best seen in FIG. 8. The plunger aperture 5 extends substantially transversely to the longitudinal axis of the button towards its central axis, where it connects with the locking aperture 2. The plunger aperture is adapted for interaction with the detent plunger 20. More specifically, the plunger aperture is adapted for insertion of the detent plunger to lock the safety button in the safe and locked position. As shown in FIG. 3, the detent plunger 20 is urged into the plunger aperture 5 by the spring 30 when the safety button has been rotated to the safe and locked position. When the safety button is in the safe and locked position, the notch 4 is no longer aligned with the trigger mechanism, and the button thus blocks the trigger. When in the safe and locked position, further rotational movement is prevented by the interaction of the detent plunger and the plunger aperture, which also prevents transverse movement. As shown in FIG. 17, the detent plunger 20 is urged out of the plunger aperture 5 by the key 50 when it has been inserted into the locking aperture. With the key inserted and urging the detent plunger away from the button, acting against the spring 30, the safety button can be rotated from the safe and locked to the safe position. The rotational movement of the safety button is limited and guided by the interaction of the detent plunger with the plunger channels, as described below. Similarly, the transverse movement of the safety button is limited and guided by the interaction of the detent plunger with the plunger channels.

Figure 4:
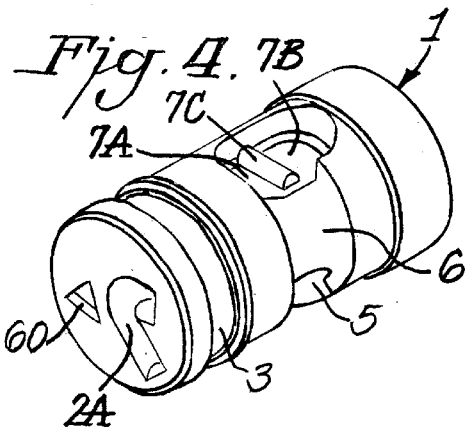
FIG. 4 is an isometric view of a safety button of the first embodiment of the safety mechanism of the present invention.
Figure 5:
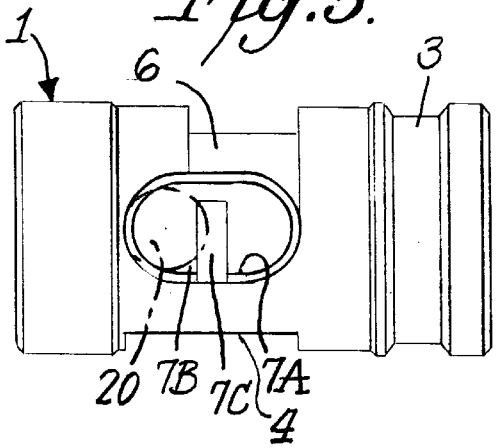
FIG. 5 is a bottom plan view of the safety button shown in FIG. 2, showing the position of the detent plunger, in phantom outline, when the safety button is in the fire position shown in FIG. 1.
Figure 6:
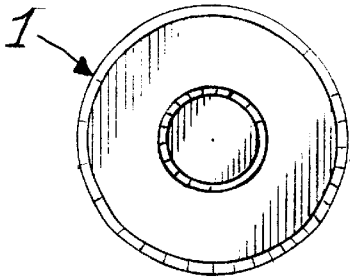
FIG. 6 is a left end elevational view of the safety button of FIGS. 4 and 5.

The plunger aperture 5 is operatively connected to a substantially transverse plunger channel 6, as best shown in FIGS. 4 and 8. The transverse plunger channel is substantially transverse to the longitudinal axis of the button, and is adapted to interact with the detent plunger. The interaction of the detent plunger 20 with the transverse plunger channel 6 defines and limits the rotational movement of the safety button.

The transverse plunger channel 6 is operatively connected to the longitudinal plunger channel 7 at a first portion 7A thereof, as best shown in FIGS. 4, 5, 8 and 10. The longitudinal plunger channel 7 further comprises a second portion 7B. A detent surface 7C is formed in the longitudinal plunger channel 7 between the first and second portion thereof The interaction of the detent plunger 20 with the longitudinal plunger channel 7 defines and limits the transverse movement of the safety button. When the detent plunger 20 is positioned in the second portion 7B of the longitudinal plunger channel, the safety button is in the fire position. When the detent plunger 20 is in the first portion 7A of the longitudinal plunger channel, the safety button is in the safe position, from which it can be rotated to the safe and locked position. The detent surface 7C urges the detent plunger 20 into either portion of the longitudinal plunger channel and positively retains the plunger in such position.

The safety button is shown in FIG. 1 in the fire position, where the receiving notch 4 is aligned with a portion of the trigger and positioned to allow the trigger to pivot when pulled. If the safety button is pushed in along the line shown in FIG. 2, the receiving notch 4 will no longer be aligned with the trigger mechanism, and the movement of the trigger will be blocked by the outer diameter of the safety button, adjacent to the notch.

As shown in FIGS. 1–3, and especially FIG. 2, the various embodiments of the safety mechanisms of the present invention are moveable between two transverse and two rotational positions. As shown in FIG. 3, the safety button is in the safe and locked position, wherein the detent plunger interacts with and enters the plunger aperture. As shown in FIG. 1, the safety button is in the fire position, wherein the notch is aligned with a portion of the trigger mechanism and the detent plunger interacts with the second portion 7B of the longitudinal plunger channel The safety mechanisms of the present invention are configured to allow for rotational movement as well as transverse movement of the safety button, as described above. Only when the present safety button is in the first transverse position can it be rotated among a first and second rotational position. The first rotational position, wherein the detent plunger interacts with the first portion of the longitudinal plunger channel, also corresponds to the safe position described above. The second rotational position, wherein the detent plunger interacts with and enters the plunger aperture, is the safe and locked position. The safety button can be rotated between the two rotational positions as guided by the interaction of the detent plunger and the transverse plunger channel.

When the detent plunger is in the first portion of the longitudinal channel, the firearm is in the safe position, and the rotational movement of the safety button is possible, and when the detent plunger is in the second portion of the longitudinal channel, the firearm is in the ready to fire position, and rotational movement of the safety button is not possible.

When the detent plunger is in the plunger aperture, the safety mechanism is in the safe and locked position, wherein a portion of the plunger extends through the plunger aperture and into the locking aperture. When the detent plunger is in the plunger aperture, the safety button is in the second rotational position, and the trigger assembly of the firearm is locked in the safe position and cannot be activated. In this position, the safety button cannot be rotated to the first rotational position until the locking means is inserted into the locking aperture to a position where the locking means contacts the detent plunger and urges it away from the safety button, thus removing the detent plunger from within the plunger aperture and allowing the safety button to be rotated so that the detent plunger interacts with the transverse plunger channel as the safety button rotates.

The location of the safety button with respect to the firearm shown in the embodiment of the present invention illustrated in the Figures is preferred because of its accessibility, visibility, and similarity to the position of previous safety mechanisms in firearms having a similar fire control. This location is also preferred for aesthetic reasons and for allowing efficient production of firearms because it does not require the modification of other components of the firearm to accommodate the present safety mechanism. The position of the safety mechanism can be varied, as will be evident to those skilled in the art. For example, the safety button can be placed in front of the trigger in a position above the pivot point of the trigger, thus blocking forward motion of the top of the trigger and preventing the trigger from being pulled rearward by anyone attempting to fire the firearm. Such locating of a safety mechanism of the present invention, however, may require relocating or redesigning of the fire control and any part thereof that is linked to the trigger.

As shown in the Figures, the preferred safety button 1 of the present invention is substantially cylindrical in shape. A substantially cylindrical shape is preferred for aesthetic reasons and for ease in incorporating the present invention into various types of firearms already adapted for use with traditional cylindrical safety bolts, however, other shapes and configurations are within the scope of the present invention and will be evident to those skilled in the art, depending on the overall configuration of the firearm for which the present lockable safety mechanism will be used.

As shown in the Figures, preferred embodiments of the safety button further comprises a transverse position indicator 3, which in the preferred embodiment consists of a radial band at one end of the button, typically painted red. The red radial band that forms the preferred transverse position indicator is positioned so that it is visible to the operator of the firearm when the safety button is in a first transverse position, preferably the fire position where the safety button does not prevent the trigger from moving.

Figure 11:
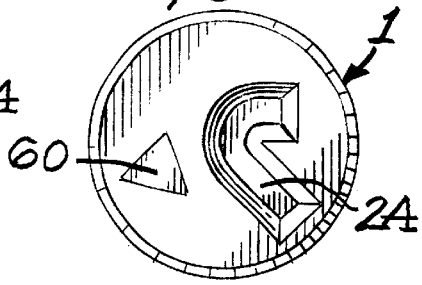
FIG. 11 is a right end elevational view of the safety button of FIGS. 4 through 7.

In preferred embodiments of the safety mechanism of the present invention, the safety button further comprises a rotational position indicator 60, shown in FIGS. 4 and 11. An alternate embodiment of the rotational position indicator 60 is shown in FIG. 13, on the opposite side of the button as the embodiment shown in FIGS. 4 and 11. The embodiment shown in FIGS. 4 and 11 is particularly preferred, as it can be viewed by an operator as the operator inserts the key and rotates the button. The rotational position indicator can be viewed by an operator of the firearm to determine whether or not the firearm is in the safe and locked position.

Figure 14:
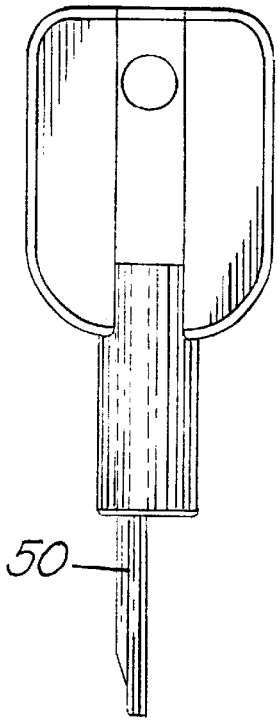
FIG. 14 is a front elevational view of a locking means, or key, of the present invention.
Figure 15:
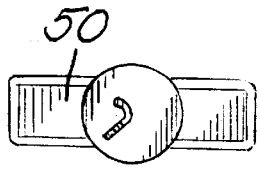
FIG. 15 is a plan view of FIG. 14.
Figure 16:
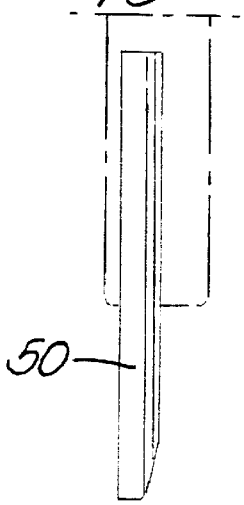
FIG. 16 is a fragmental rear elevational view of FIGS. 14–15.

Embodiments of the key 50, shown in FIGS. 13–16, show one preferred locking means adapted for insertion into the female receiving end of the locking aperture. Other locking means can include a wire or rod and a blade. Although a wide variety of locking means can be used, a key is preferred. The key is adapted for insertion into the locking aperture, extending a sufficient distance into the aperture so as to be positioned to interact with the detent plunger 20 when the detent plunger is positioned within the plunger aperture. The preferred key has a beveled tip, as shown in FIGS. 13, 14 and 16. The beveled tip is adapted to interact with the detent plunger as the key is fully inserted into the locking aperture, urging the plunger away from the safety button and out of the plunger aperture and allowing the safety button to be rotated out of the safe and locked position to the safe position.

The key can comprise a variety of handles, as shown in the Figures, including the flat handle shown in FIGS. 14–16 and the cylindrical handle shown in FIG. 13.

It is preferred that the key have high torsional strength, so that it have a thin cross section and to make the key difficult to copy. A thin key will also deter the use of paper clips and other readily available articles from being used to "pick" the safety mechanism. Many known means of imparting torsional strength can be used, including selecting a suitable material. In addition, the key can be configured to increase its torsional strength. For example, the key can be formed from a piece of metal which has been bent, the bend providing rigidity and torsional strength. As shown in the Figures, preferred keys can have a "j" shaped cross section, showing one possible way of providing a key having high torsional strength. Other cross sectional configurations will also impart torsional strength to the key, as will be evident to those skilled in the art.

The various embodiments of the safety mechanism of the present invention are adaptable with minor modifications to a wide variety of firearms, including those having manually operated, gas operated, and recoil operated actions, and including rifles, shotguns, and handguns.

I claim:

1. A safety mechanism for use in a firearm comprising:

A. a substantially cylindrical safety button having a first end and a second end and comprising:

i. a locking aperture formed along a substantially longitudinal axis of the button comprising a female receiving end formed in the first end of the button;

ii. a receiving notch formed in the surface of the button between the first and second ends of the button;

iii. a plunger aperture formed in the surface of the button between the first and second ends of the button, extending substantially transverse to the longitudinal axis of the button toward the central axis of the button and connecting with the substantially longitudinal locking aperture, the plunger aperture being operatively connected to:

iv. a substantially transverse plunger channel, operatively connected to:

v. a first portion of a substantially longitudinal plunger channel, the substantially longitudinal plunger channel comprising the first portion and an operatively connected second portion, each portion being separated by a detent surface;

vi. a rotational position indicator formed on one end of the safety button.

B. a detent plunger;

C. means to bias the detent plunger towards the safety button and into a position where the detent plunger interacts with one of the plunger aperture, the substantially longitudinal plunger channel and the substantially transverse plunger channel; and D. locking means adapted for insertion into the female receiving end of the locking aperture of the safety button, wherein the locking means is adapted to interact with the plunger aperture when inserted into the female receiving end.

2. A safety mechanism of claim 1 wherein the rotational position indicator is formed on an end opposite the female receiving end.

3. A safety mechanism of claim 1 wherein the locking means is a key.

4. A safety mechanism of claim 3 wherein the key has a substantially "J" shaped cross section.

5. A safety mechanism of claim 3 wherein the key has a beveled tip adapted to urge the detent plunger away from the safety button when the key is inserted into the locking aperture.

6. A safety mechanism of claim 1 wherein the locking means is adapted to interact with the plunger aperture only when the locking means is fully inserted into the female receiving end.

7. A safety mechanism of claim 1 further comprising a transverse position indicator formed on the button.

8. A firearm comprising a safety mechanism of claim 1.

9. A safety mechanism for use in a firearm comprising:

a safety button comprising a body having a first end and a second end, the button being transversely movable between a safe and a fire position and rotatable between the safe position and a safe and locked position;

a locking aperture formed along a substantially longitudinal axis extending through said body of the safety button and having an opening formed in one end of the safety button;

a plunger aperture formed in the safety button between the first and second ends and communicating with the locking aperture, and in which the detent plunger is received as the safety button is rotated from a safe position to a safe and locked position;

a substantially transversely extending plunger channel formed adjacent and operatively connected to the plunger aperture, and a longitudinal plunger channel connected to the transverse plunger channel and including a detent surface formed therealong a detent plunger adapted to lock the safety button in the safe and locked position and to prevent further movement of the safety button; and a key adapted to be received through a key hole formed adjacent to the locking aperture in the safety button, the key being adapted to engage the detent plunger for moving said detent plunger out of engagement with said safety button to enable rotation of the safety button from the safe and locked position to the safe position, whereby the key is received within the locking aperture and engages the detent plunger for moving the detent plunger out of engagement with the safety button a means for biasing the detent plunger toward engagement with the safety button a transverse position indicator on the safety button and wherein the key has a substantially curved cross sectional configuration.

10. A firearm safety device of claim 9 further including a rotational position indicator formed adjacent one end of the safety button.

11. A firearm comprising a safety machanism of claim 9.

* * * * *